United States Patent [19]

Waller

[11] 4,215,752

[45] Aug. 5, 1980

[54] VEHICULAR FIRE SUPPRESSANT SYSTEM HAVING A FRANGIBLE FIRE EXTINGUISHANT HOUSING

[75] Inventor: Gail J. Waller, Centerline, Mich.

[73] Assignees: Kenneth W. Gerow; Joyce M. Gerow, both of Snover, Mich. ; part interest to each

[21] Appl. No.: 943,136

[22] Filed: Sep. 18, 1978

[51] Int. Cl.[2] ..... A62C 35/12; A62C 37/14

[52] U.S. Cl. ..... 169/58; 169/62

[58] Field of Search ..... 169/26, 28, 29, 58, 169/62, 66; 141/2, 18

[56] References Cited

U.S. PATENT DOCUMENTS

| | | | |
|---|---|---|---|
| 1,641,328 | 9/1927 | Ferdinand | 141/18 |
| 1,668,940 | 5/1928 | Burke, Jr. | 169/58 |
| 1,838,655 | 12/1931 | Bronander | 169/62 X |
| 2,800,966 | 7/1957 | McKissick | 169/62 X |
| 2,841,228 | 7/1958 | Porterfield | 169/58 |
| 2,906,300 | 9/1959 | Becher | 141/18 |
| 2,911,049 | 11/1959 | Crouch | 169/58 X |
| 3,961,669 | 6/1976 | Kaneko | 169/62 |

*Primary Examiner*—Robert J. Spar

*Assistant Examiner*—Fred A. Silverberg

*Attorney, Agent, or Firm*—Gifford, Van Ophem, Sheridan & Sprinkle

[57] ABSTRACT

A fire suppressant system is provided for a vehicle having a body and a fuel tank mounted to the rear end of the body and rearwardly of a rear axle differential. The fire suppressant system comprises an elongated cylindrical housing defining a closed interior chamber which in turn is filled with a pressurized liquid fire suppressant material. The housing is secured to the vehicular body in between the front end of the fuel tank and the rear axle differential so that forward displacement of the fuel tank, as would occur in the event of a rear end collision, contacts and breaks the housing thereby releasing the fire suppressant material which ejects onto and over the fuel tank. In a modified form of the invention, an elongated housing defining a closed interior chamber is filled with a pressurized fire suppressant material mounted onto the top of a fuel tanker truck. A normally closed valve is opened by a temperature device which releases the pressurized fire suppressant material over and onto the sides of the tanker truck at a predetermined temperature indicative of a fire in the immediate area.

4 Claims, 7 Drawing Figures

VEHICULAR FIRE SUPPRESSANT SYSTEM HAVING A FRANGIBLE FIRE EXTINGUISHANT HOUSING

BACKGROUND OF THE INVENTION

I. Field of the Invention

The present invention relates generally to fire extinguisher and suppressant systems and, more particularly, to such a system adapted for vehicular use.

II. Description of the Prior Art

Fires resulting from collision, accidents and the like have become an increasingly serious problem for passenger vehicles, such as cars, small trucks and the like. Typically these vehicles have a fuel tank mounted to the body of a car rearwardly of the rear axle differential. In the event of a serious rear end collision, the fuel tank is displaced forwardly which oftentimes ruptures the tank against the rear axle differential. The leakage of fuel from the ruptured fuel tank then can ignite whereupon the flames can rapidly enter the passenger compartment from behind the vehicle rear seat.

There have, however, been a number of previously known vehicular fire extinguisher systems. These previously known extinguisher systems, however, have not enjoyed widespread acceptance or use for a number of different reasons.

Many of these previously known fire extinguishing systems employ complicated and expensive means for actuating the fire extinguisher system in the event of a collision to the vehicle. The previously known activating devices thus were not only very costly but also unreliable in use. Moreover, many of these previously known devices activated upon relatively minor rear end collisions when forward displacement, and thus rupture of the fuel tank does not occur. Furthermore, since several separate fire extinguishing devices are required in order to adequately protect the vehicle from collisions to different points on the vehicle. This, of course, increased the overall cost of the fire extinguishing system.

These previously known vehicular fire extinguishing systems are also disadvantageous in that even upon activation of the fire extinguishing system, the fire suppressant materials are ejected only over the rearward end of the fuel tank rather than the forward end of the fuel tank adjacent the vehicle passenger compartment. As such, these previously known systems have been inadequate in protecting the vehicle passenger compartment from fire.

No previously known vehicle fire extinguishing system known to Applicant has been specifically designed for use with a fuel tanker truck. Due to the enormous amount of fuel or other flammable material carried by such tanker trucks, an accident with such tanker trucks can cause devastating damages.

SUMMARY OF THE PRESENT INVENTION

The present invention overcomes all of the above mentioned disadvantages of the previously known vehicular fire extinguisher system by providing such a system which is simple and inexpensive in construction and yet totally effective in operation.

In brief, the present invention comprises an elongated cylindrical housing defining an interior closed chamber which is filled with a pressurized fire suppressant material. The housing is secured laterally to the body of the vehicle in between the front end of the vehicle fuel tank and the rear axle differential.

In the event of forward displacement of the fuel tank, as would occur during a rear end collision sufficiently severe to rupture the fuel tank, the fuel tank crushes and breaks the fire extinguisher housing against the rear axle differential. This, in turn, releases the pressurized fire suppressant material onto and over the fuel tank thereby extinguishing or preventing any fire from leakage of fuel from the ruptured fuel tank. Moreover, since the fire suppressant material is ejected from the front of the fuel tank and toward the rear, the extinguisher system according to the present invention effectively protects the passenger compartment from fire.

In a modified form of the invention, the fire extinguisher housing is mounted on top of a fuel tanker truck and has a plurality of spray nozzles extending downwardly from the fire extinguisher housing and along the side of the tanker truck. As before, the extinguisher housing is filled with a compressed fire suppressant material while a normally closed valve means is fluidly connected between the housing chamber and the spray nozzles. The valve means is responsive to a heat sensing device which opens the valve means at a predetermined temperature indicative of a fire to expel the fire suppressant material through the spray nozzles and quench the fire.

BRIEF DESCRIPTION OF THE DRAWINGS

The present invention will be better understood by reference to the following detailed description when read in conjunction with the accompanying drawing, wherein like reference characters refer to like parts throughout the several views and in which.

DETAILED DESCRIPTION OF THE PRESENT INVENTION

Figure 1:
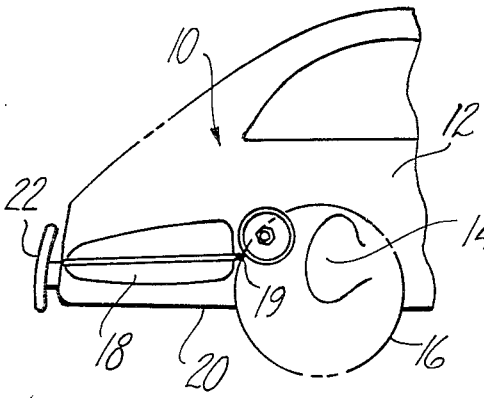
FIG. 1 is a fragmentary side view showing the system of the present invention installed in a vehicle.
Figure 2:
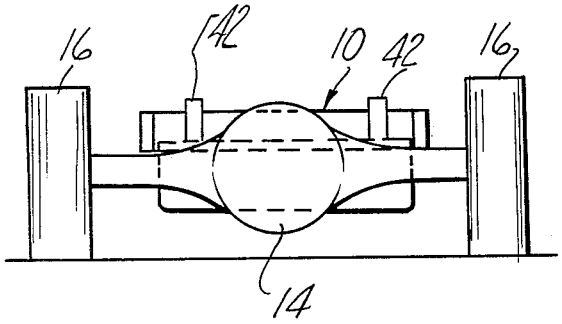
FIG. 2 is a rear view of the system of the present invention.

With reference to FIGS. 1 and 2, the fire extinguishing and suppressant system 10 according to the present invention is thereshown installed in a vehicle 12 illustrated as a passenger automobile. In the typical fashion, the vehicle 12 includes a rear axle differential 14 for drivingly connecting the vehicle engine to the vehicle rear wheels 16. A fuel tank 18 is secured to the vehicle body 20 near its rearward end 22 and rearwardly of the rear axle differential 14. Typically, the fuel tank 18 is substantially in horizontal alignment with the rear axle differential 14 and includes a forwardly protruding weld lip 19 along its front end.

Figure 3:
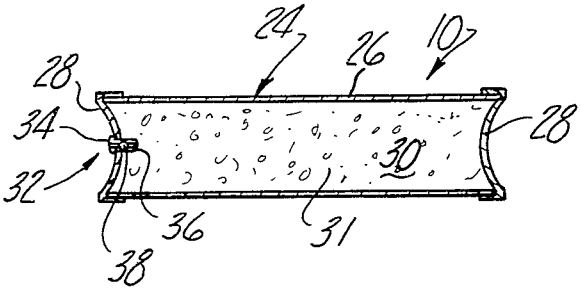
FIG. 3 is a plan view showing the system of the present invention removed from the vehicle.

With reference now to FIG. 3, the fire suppressant system 10 according to the present invention is thereshown in greater detail and includes a housing 24 having a tubular cylindrical side wall portion 26. The housing portion 26 is made of a frangible material. The axial ends of the housing 24 are closed by end caps 28 which concave inwardly for a reason to be subsequently described. The housing 24 thus defines a closed interior chamber 30 between the side wall portion 26 and the end caps 28.

The interior chamber 30 of the housing 24 is filled with a pressurized fire suppressant material 31 such as protein foam, aqueous film forming foam or Light Water, more fully described in U.S. Pat. No. 3,562,156. Although any conventional means can be employed to fill the chamber 30 with the fire suppressant material, preferably a fill means 32 having a nipple 34 accessible exteriorly of the housing 24 and a portion 36 which is open to the chamber 30 is secured to one end cap 28 of the housing 24. A one-way ball check valve is positioned in a fluid passageway 38 formed through the fill means 32 so that the pressure within the chamber 30 normally maintains the valve in a closed position.

In order to fill the chamber 30 with the pressurized fire suppressant material 31, a source of the pressurized fire suppressant material (not shown) is connected to the nipple 34 which opens the ball check valve so that the fire suppressant material 31 flows into the chamber 30. Upon removal of the external source, the now pressurized chamber 30 maintains the ball check valve in its closed position. It will also be appreciated that the nipple 34 enables the pressure within the chamber 30 to be periodically checked by a conventional gage (not shown).

With reference now to FIGS. 1 and 2, the extinguisher housing 24 is mounted to the vehicle body 20 by any conventional means, such as clamps 42 so that the housing 24 extends laterally across the vehicle body 20 and in between the forward end of the fuel tank 18 and the rear axle differential 14. Preferably, the central line of the housing 24 is elevated slightly above the center line of the fuel tank 18 so that the front lip 19 or the fuel tank 18 registers with the lower half of the housing 24.

Figure 4:
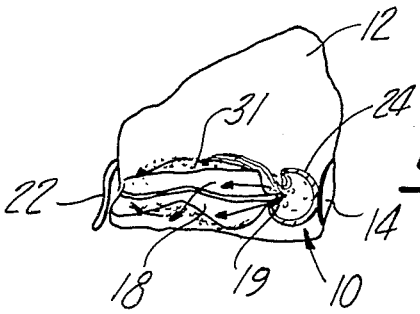
FIG. 4 is a diagrammatic view showing the operation of the system of the present invention.

With reference now to FIG. 4, the operation of the fire suppressant system 10 according to the present invention will now be described. In the event of a rear end collision sufficient to displace the fuel tank 18 forwardly, and thus sufficient to rupture the fuel tank, the fuel tank 18 and particularly the forward lip 19 of the fuel tank 18 contacts and crushes the housing 24 against the rear axle differential 14. The fracture of the housing 24 in turn releases the pressurized fire suppressant material within the chamber 30 so that the material flows over and around the fuel tank 18 thereby extinguishing any fire caused by fuel leakage from the ruptured fuel tank 18. Moreover, since the center line of the housing 24 is slightly elevated from the center line of the fuel tank 18, most of the fire suppressant material flows over the top of the fuel tank 18 thus effectively protecting the vehicle passenger compartment from flames.

Since the end caps 28 of the shousing 24 concave inwardly toward the interior chamber 30, the end caps 28 are structurely stronger than the housing side wall 26. Consequently, the housing side wall 26 first ruptures in the event of a rear end collision thus insuring that the fire suppressant materials flow over the fuel tank 18 rather than ineffectively expelled out through the axial ends of the housing 24. In addition, the relatively sharp edge on the forwardly protruding lip 19 of the fuel tank 18 insures that the housing 24 will first rupture longitudinally along its rear side so that the entire suppressant material is ejected rearwardly toward the fuel tank 18.

From the foregoing it can be seen that the fire suppressant system 10 according to the present invention provides a simple, inexpensive and yet totally efficient means for fire suppression in the event of a serious rear end collision to the vehicle 12. Since the housing 24 is only broken upon the forward displacement of the fuel tank 18, and thus only when rupture of the fuel tank 18 is likely, only a single fire extinguisher housing 24 is required for effective and complete protection.

Figure 5:
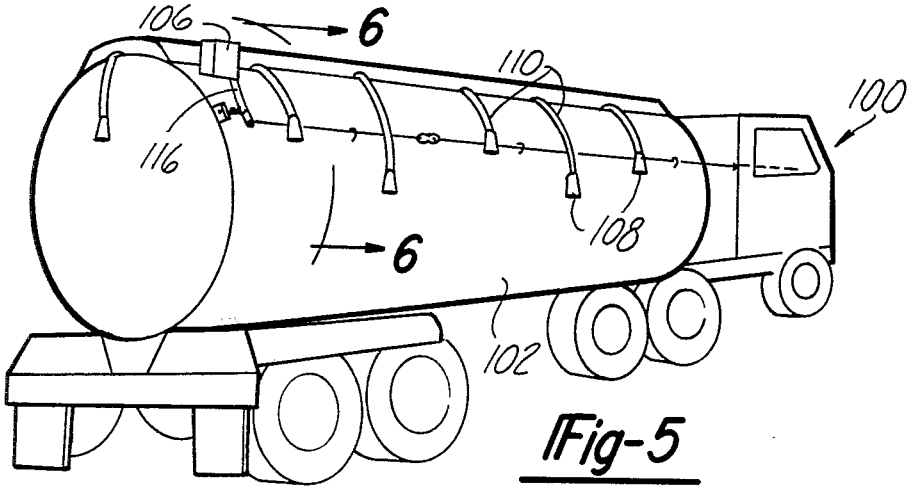
FIG. 5 is a prespective view showing a modification of the system of the present invention.
Figure 6:
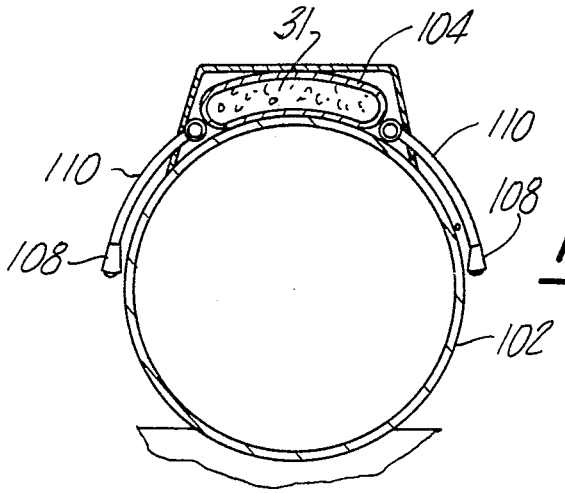
FIG. 6 is a sectional view taken along line 6—6 in FIG. 5.
Figure 7:
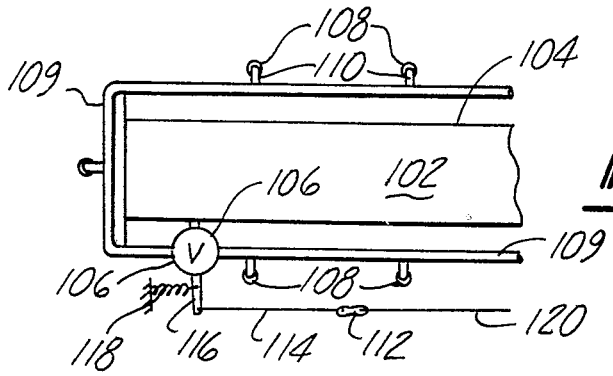
FIG. 7 is a top plan view of the system of the present invention shown in FIGS. 5 and 6.

A modification of the instant invention is illustrated in FIGS. 5–7 and is particularly adapted for use with a tanker truck 100 comprising one or more fuel tanks 102 which carry a flammable material.

At least one elongated housing 104 is secured longitudinally along and to the top of the fuel tanks 102. The housing 104 is filled with the pressurized fire suppressant material 31 and connected by a normally closed valve 106 to a plurality of downwardly extending spray nozzles 108 via manifold tubes 109. These spray nozzles 108 are preferably connected to the housings 104 by conduits 110 of varying lengths so as to insure complete and uniform coverage of the fire suppressant material upon opening of the valve 106.

A heat sensing means is provided for actuating or opening the valve 106 at a predetermined temperature indicative of a fire in the immediate area. Although any conventional heat sensing means can be employed as shown, a lead or solder link 112 is connected by a cable 114 to a valve actuating lever 116 and normally maintains the actuating lever 116 in its closed position. Resilient means 118, however, urge the lever 116 toward its open position.

In the event of a fire, the link 112 melts which releases the lever 116 so that the resilient means 118 opens the valve 106 via the lever 116 and expels the pressurized fire suppressant material through the conduits 110 and spray nozzles 108. The other end of the solder link 112 is also preferably connected by a cable 120 to a release mechanism (not shown) in the driver's compartment for manual opening of the valve 106 and thus manual actuation of the fire suppressant system.

Having described my invention, however, many modifications thereto will become apparent to those skilled in the art to which it pertains without deviation from the spirit of the invention as defined by the scope of the appended claims.

I claim:

1. In combination with a vehicle having a body, a fuel tank secured to the body adjacent its rear end, the forward side of said fuel tank having a predetermined width, and a relatively stationary member secured to the vehicle body forwardly of the fuel tank, a fire suppressant system comprising:

an elongated tubular and cylindrical housing constructed of a frangible material, said housing having a length at least as great as the width of the forward side of said fuel tank;

means for closing both ends of the housing to thereby define a closed housing chamber;

said housing chamber being filled with a pressurized liquid fire suppressant material;

means for securing said housing to said vehicle body so that said housing extends laterally across the forward side of the fuel tank; and wherein the forward displacement of the fuel tank crushes said frangible housing between said fuel tank and said stationary member and releases the fire suppressant material over said fuel tank;

wherein said means for closing the ends of the housing comprises an end cap secured across each axial end of the housings, each said end cap having a surface which protrudes concavely inwardly toward the housing chamber, said end caps being structurally stronger than said housing; a nipple secured to one of said end caps, said nipple having one end open to said housing chamber and another end accessible exteriorly of the end cap, fluid passage means extending between the ends of the nipple and a one way valve disposed in the fluid passage means, said one way valve being normally held in a closed position by the pressure within the housing chamber and operable, upon opening, to permit said housing chamber to be filled with said fire suppressant material; at least a portion of said housing extending above the fuel tank, a horizontal centerline of the housing being positioned above a horizontal centerline of the fuel tank so that upon rupture of the housing, a substantial portion of said fire suppressant material is expelled over the top of the fuel tank.

2. The invention as defined in claim 1 wherein said fire suppressant material is a foam.

3. The invention as defined in claim 1 wherein said relatively stationary member is a rear axle differential for the vehicle.

4. The invention as defined in claim 1 wherein said fuel tank includes a forwardly protruding lip which registers with said housing.

* * * * *

UNITED STATES PATENT AND TRADEMARK OFFICE

CERTIFICATE OF CORRECTION

PATENT NO. : 4,215,752

DATED : August 5, 1980

INVENTOR(S) : Gail J. Waller

It is certified that error appears in the above-identified patent and that said Letters Patent are hereby corrected as shown below:

Column 2, line 43, delete "prespective" and insert --perspective-- therefor;

Column 2, line 63, after "lip" delete "19";

Signed and Sealed this

*Twenty-fifth* Day of *November 1980*

[SEAL]

*Attest:*

SIDNEY A. DIAMOND

*Attesting Officer*

*Commissioner of Patents and Trademarks*